US006895676B1

(12) United States Patent
Mendyk

(10) Patent No.: US 6,895,676 B1
(45) Date of Patent: May 24, 2005

(54) ARCHERY SCOPE MOUNT

(76) Inventor: Patrick Mendyk, 9847 Oakley Rd., St. Charles, MI (US) 48655

( * ) Notice: Subject to any disclaimer, the term of this patent is extended or adjusted under 35 U.S.C. 154(b) by 17 days.

(21) Appl. No.: 10/752,655

(22) Filed: Jan. 8, 2004

(51) Int. Cl.[7] ..... F41G 1/467
(52) U.S. Cl. ..... 33/265; 124/87
(58) Field of Search ..... 33/265; 124/87, 124/88; 42/124, 125, 137

(56) References Cited

U.S. PATENT DOCUMENTS

| | | | | | |
|---|---|---|---|---|---|
| 3,266,149 | A | | 8/1966 | Powell | |
| 3,368,282 | A | | 2/1968 | Gilbson et al. | |
| 3,377,999 | A | * | 4/1968 | Bennett | 124/88 |
| 3,495,339 | A | * | 2/1970 | Elliason | 42/137 |
| 4,237,615 | A | | 12/1980 | Bracknell | |
| 4,291,469 | A | | 9/1981 | Weast | |
| 5,040,300 | A | | 8/1991 | Sheffield | |
| 5,289,814 | A | * | 3/1994 | Maisano | 124/87 |
| 5,341,791 | A | * | 8/1994 | Shafer | 124/87 |
| 5,367,780 | A | | 11/1994 | Savage | |
| 5,428,901 | A | * | 7/1995 | Slates | 33/265 |
| 5,465,491 | A | | 11/1995 | Thell | |
| 5,941,489 | A | * | 8/1999 | Fanelli et al. | 42/125 |
| 6,003,233 | A | | 12/1999 | Vaughn et al. | |
| 6,418,657 | B1 | * | 7/2002 | Brown | 42/124 |
| 6,644,297 | B1 | * | 11/2003 | Brown, Jr. | 124/87 |
| 6,678,988 | B1 | * | 1/2004 | Poff, Jr. | 42/124 |
| 2004/0000083 | A1 | * | 1/2004 | Grant, Jr. | 42/124 |
| 2004/0007224 | A1 | * | 1/2004 | Brown, Jr. | 124/87 |
| 2004/0205971 | A1 | * | 10/2004 | Terry et al. | 33/265 |

* cited by examiner

*Primary Examiner*—G. Bradley Bennett
(74) *Attorney, Agent, or Firm*—John J. Swartz

(57) ABSTRACT

This invention relates to a one-piece lightweight, compact, low profile adjustable scope mount for mounting a sighting scope on a lateral side surface of an archery bow. The mount includes a dovetail sight mounting rail which projects perpendicular away from the bow and includes a plurality of spaced apart scope receiving channels therein. The mount is detachably swingably mounted on the bow and allows the user to adjust the adjustable mounting plate either vertically and/or horizontally. The adjustable scope mount is unitary in construction and extends a very short distance away from the inside riser of the bow whereby making it virtually impossible to inadvertently move the plate. The adjustment of fasteners is all that is required to make vertical and/or horizontal adjustments.

40 Claims, 3 Drawing Sheets

ARCHERY SCOPE MOUNT

BACKGROUND OF THE INVENTION

1. Field of the Invention:

This invention relates to an archery scope mount and more particularly to a new and novel light weight, one-piece low-profile mount for adjustably mounting a scope on an archery bow.

2. Description of Prior Art and Objects:

Many have adapted sights and telescopes, hereinafter referred to as scopes, on archery bows. The heed for a sight stems from the gravitational force placed upon the arrow as it makes its way to the chosen target. When the arrow is released from the bowstring, gravity instantly reacts, pulling the arrow toward the ground. The use of sights and scopes is an effort to compensate the gravitational effect. In order for this to happen, the sight must balance the distances over the gravitational forces to reach the goal. Many situations require the archer to determine the distance with nothing more than the archer's perception. This is the basis for the adjustability of the mounting plate of the present invention. The combination of perception and the capability to adjust the sighting mechanism of a bow allows a greater degree of success for the archer.

Archery sight mounts have heretofore typically been mounted on the outer surface of the archery bow riser, opposite the side of the arrow rest, and include structure which extends around the bow to mount the sight on the inner side of the bow, adjacent the arrow rest. U.S. Pat. No. 6,003,233 issued to Donald L. Vaughn et al on Dec. 21, 1999, discloses such a preexisting sight mount.

A similar prior art scope mount, sold under the trademark HHA Optimizer Lite, is illustrated as catalog no. SB-41-4979 at page 407 of the 40$^{th}$ Anniversary Master Catalog Fall 2001, Edition II, published by Cabella's Inc., Sidney, Nebr.

Frequently, such bow sight mounts also mount an archery quiver which releasably stores a plurality of vertically disposed arrows adjacent the outer side of the bow. Not only are the bow sights large, protruding and easily inadvertently hit but, the quivers are particularly massive and more easily inadvertently hit jarring the bow sight out of alignment. Also, if the archer is hunting in inclement weather, including freezing rain, the quiver and arrows therein will sometimes "ice over". In attempting to detach the frozen arrows, the archer will sometimes dislodge the prior art scope mount. Accordingly, it is an object of the present invention to provide a new and novel sight mount which mounts on the inside of a bow adjacent the arrow rest.

It is another object of the present invention to provide a new and novel scope mount which has a low profile, but yet allows the scope to be adjustably mounted.

It is yet another object of the present invention to provide a new and novel sight mount which can be horizontally and vertically adjusted on the bow.

Other scope mounts include L-shaped brackets which include a cantileverly supported leg lying in a plane parallel to the plane of the bow. One such sight mount is illustrated in U.S. Pat. No. 4,237,615 issued to Paul A. Bracknell on Dec. 9, 1980. The aforementioned HHA Optimizer Lite scope mount is similar. The prior art bracket and scope mount also projects a substantial distance away from the bow to a position underlying the scope mounted thereon. Accordingly, it is another object of the present invention to provide a one-piece scope mount having a base which lies in a plane parallel to the plane of the bow and an integral mounting projection lying in a plane which is perpendicular to the bow and intersects the axis of a scope.

A further object of the present invention is to provide a one-piece scope mount of the type described including a base plate lying in a predetermined plane and having a horizontal midpoint and an integral dovetail scope mounting protrusion thereon which lies in a plane perpendicular to the plane of the base and intersecting the midpoint.

The mount illustrated in the Bracknell patent also discloses ring mounts which include various parts that are detachably coupled to a scope and can relatively move and, along with the rest of the structure, disclosed therein, provide inevitable circumstances that would cause the Bracknell mount to become easily misaligned. Accordingly, it is a still further object of the present invention to provide a scope mount which is one-piece has a low profile to reduce the chances of being inadvertently knocked out of alignment.

U.S. Pat. No. 4,291,469 issued to Norman J. Weast on Sep. 29, 1981, also discloses a scope mount for an archery bow including rings for holding the scope to the mount. The use of rings provide many additional parts which can be inadvertently decoupled and/or relatively moved to disrupt the sight. Accordingly, it is an object of the present invention to provide a one-piece mount with an integral, scope mounting dovetail protrusion.

Other examples of prior patents having sight mounts with a large number of moving parts are as follows:

| U.S. Pat. No. | Patentee | Issue Date |
|---|---|---|
| 3,266,149 | L. Y. Powell | August 16, 1966 |
| 3,368,282 | D. E. Gibson et al | February 13, 1968 |
| 5,040,300 | Sheffield | August 20, 1991 |
| 5,367,780 | Savage | November 29, 1994 |
| 5,465,491 | Thell | November 14, 1995 |

It is another object of the present invention to provide a new and novel one-piece scope mount of the type described having a base plate integrally mounting an elongate, dovetail scope mounting bar including upper and lower edge portions having parallel elongate grooves and a plurality of longitudinally spaced apart channels, disposed perpendicular to the scope mounting bar in a laterally outer terminal side surface of the sight mounting bar.

It is yet another object of the present invention to provide a scope mount of the type described wherein the base plate lies in a plane and the laterally outer terminal side surface of the dovetail scope mounting bar lies in a plane parallel to the plane of the base plate.

Yet another object of the present invention is to provide a new and novel one-piece scope mount of the type described having a plurality of mounting apertures therethrough, the lowermost one of which has an arcuate configuration.

Other objects and advantages of the present invention will become apparent to those of ordinary skill in the art as the description thereof proceeds.

SUMMARY OF THE INVENTION

The invention relates to one-piece adjustable mounting plate for an archery scope having an adjustable mounting base provided with one lateral side surface, for bearing against a bow and an opposite laterally side surface.

The base plurality of vertically spaced apart mounting openings therethrough with the lower-most opening forming an arcuate configuration.

Also present is a mounting bar disposed laterally integral to, but projecting laterally outwardly from, the opposite lateral side surface of the base. The mounting bar has an elongate dovetail protrusion having upper and lower edge portions and another laterally outer terminal surface, spaced laterally outwardly of the opposite lateral side of the base, disposed between the upper and lower edge portions. The mounting bar also includes a horizontal groove in each of the horizontal edge portions. The laterally outer terminal surface of the dovetailed protrusion has a plurality of channels therein that extend perpendicularly to the upper and lower edge portions.

The dovetailed protrusion facilitates the slidable mounting of an archery scope which can slidably move on the dovetailed protrusion of the mount. The scope then secures to the dovetailed protrusion in a manner that allows tightening devices of the scope to set in the elongate grooves while the outer edge of the scope securely grasps the horizontal edges of the dovetailed protrusion.

The adjustable mount base lies in a plane parallel to the plane of the bow and the integral dovetail tail protrusion lies in a plane perpendicular to the planes of the base and the bow. The laterally outermost surface on the dovetail protrusion lies in a plane parallel to the planes of the base and the bow.

The scope mount includes a first pair of mounting apertures therein which are spaced apart a predetermined distance for receiving fasteners that are received in similarly spaced apart openings in the bow to fix the base plate to the bow. The scope mount further includes a second pair of alternative mounting aperture which are spaced apart the same predetermined distance with the lowermost one of the second pair of openings being arcuately shaped and guiding on a fastener to allow the plate to be swung about a fastener received in the upper one of said second pair of openings.

BRIEF DESCRIPTION OF THE DRAWINGS

The invention may be more readily understood by referring to the accompanying drawings, in which.

DETAILED DESCRIPTION OF THE INVENTION

Figure 1:
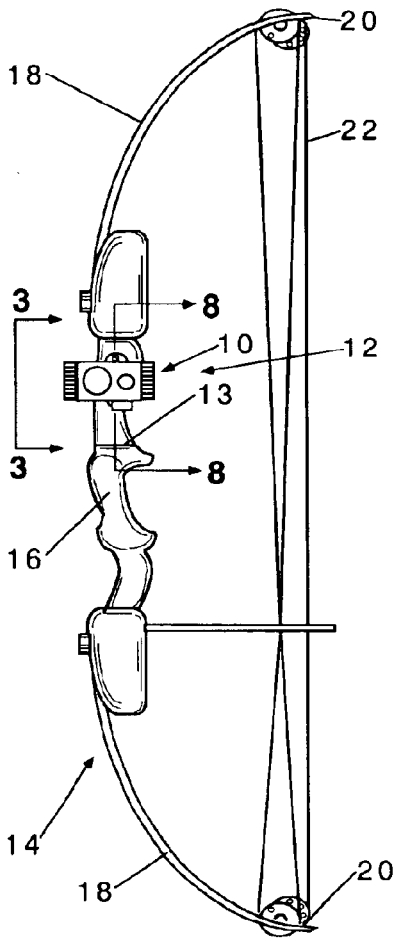
FIG. 1 is a side elevational view of a standard compound archery bow incorporating an adjustable scope mount constructed according to the present invention.
Figure 2:
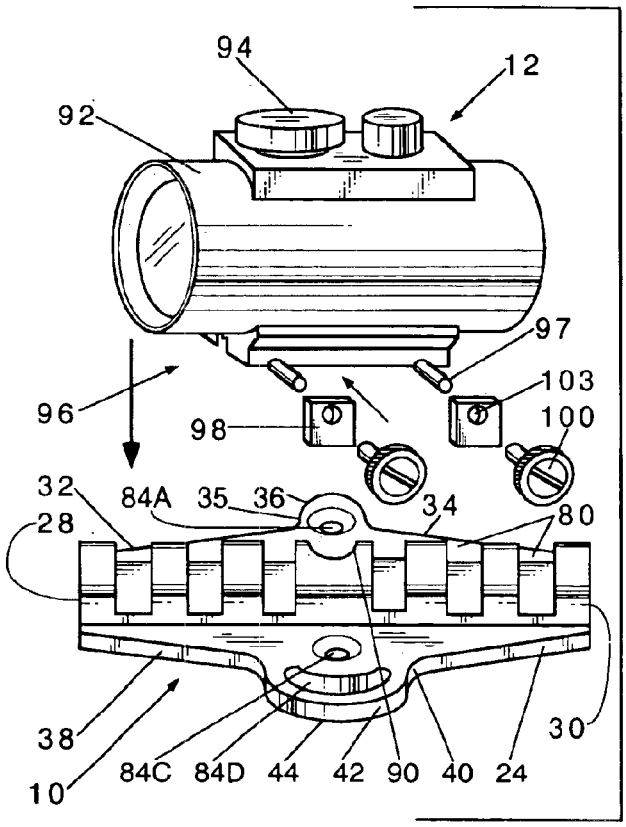
FIG. 2 is an enlarged, exploded perspective view illustrating an adjustable scope mount constructed according to the present invention and a scope that is attachable to the adjustable mount.
Figure 3:
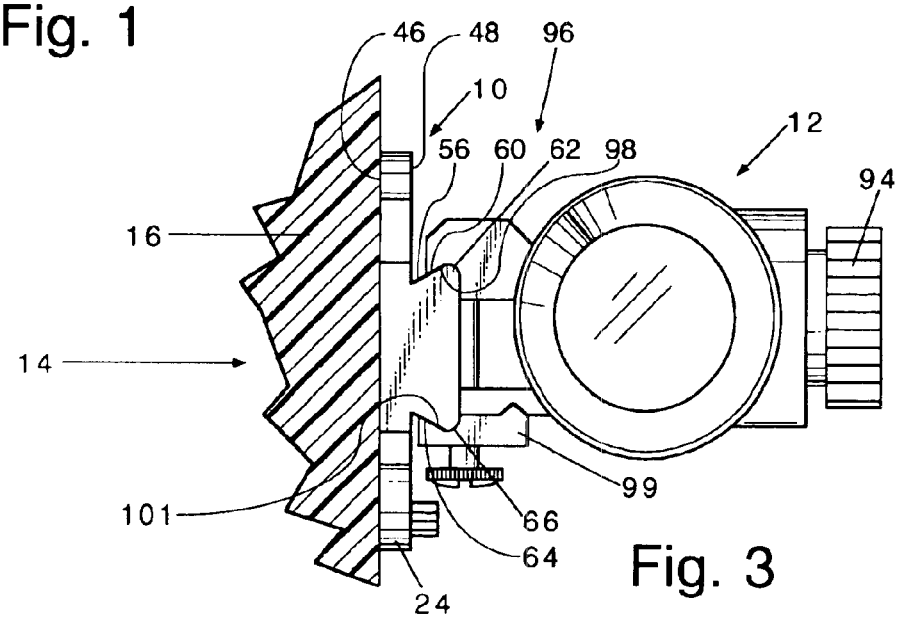
FIG. 3 is a greatly enlarged front elevational view, taken along the line 3—3 of FIG. 1, with part of the bow riser being broken away in section to more particularly illustrate the adjustable mount constructed according to the present invention and the scope mounted thereon.

A scope mount, generally designated 10, constructed according to the present invention, is particularly adapted for mounting a scope 12 on a typical compound archery bow, generally designated 14, including a central riser 16 coupled to upper and lower curved bow portions 18 having terminal ends 20 spanned by a bow string 22, as usual. The riser 16 includes lateral sides 11. An arrow rest 13 is mounted on the lateral side 11 of the bow which is closest to the archer. Vertically spaced internally threaded, laterally outwardly opening, open ended threaded ferrules 17 and 19 are disposed in the riser 16 flush with the surface the lateral surface 11 adjacent the arrow rest 13. The axes of the ferrules 17 and 19 are spaced apart a distance D. The bow 14 lies in a predetermined plane 15.

The scope mount 10 includes an elongate base or plate 24 lying in a plane 26 parallel to the plane 15. The base 24 includes longitudinally spaced apart front and rear ends 28 and 30, respectively, spanned by upper and lower upwardly converging upper edge portions 32 and 34 which, at their juncture, form a semi-cylindrical projection icluding an upper terminal edge portion 36. The base 24 also includes downwardly converging lower edge portions 38 and 40 which, at their inner adjacent ends, form a curved protuberance 42 which defines a lower terminal edge portion 44. The base plate 24 includes a laterally inner surface 46 for bearing against the lateral side surface 11 of the bow riser 16 adjacent arrow rest 13 and a laterally outer surface 48 parallel to the surface 46.

The scope mount 10 includes an elongate dovetail guide, generally designated 50, integrally formed with the laterally outer surface 48 of the base plate 24. The base 24 includes a vertical mid-point V (FIG. 4) which lies midway between the upper and lower terminal edge portions 36 and 42, respectively, and a horizontal mid-point M which lies horizontally midway between the front and rear ends 28 and 30, respectively.

Figure 5:
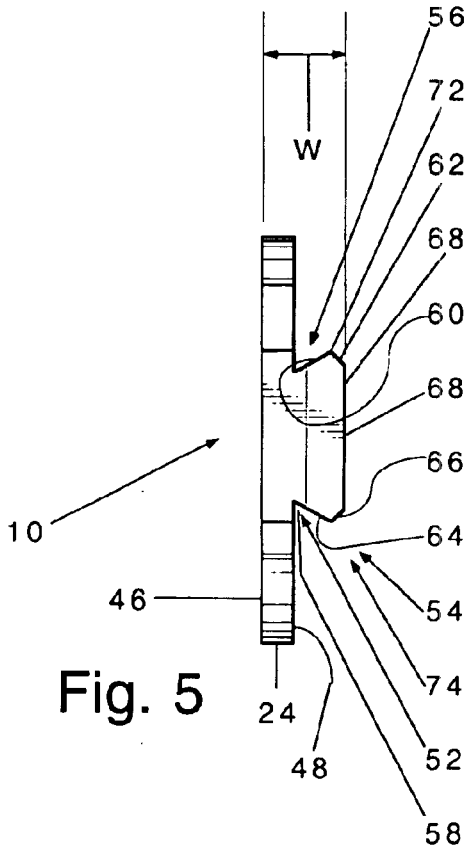
FIG. 5 is a front end elevational view, taken along the line 5—5 of FIG. 4, illustrating the dovetail protrusion configuration.
Figure 6:
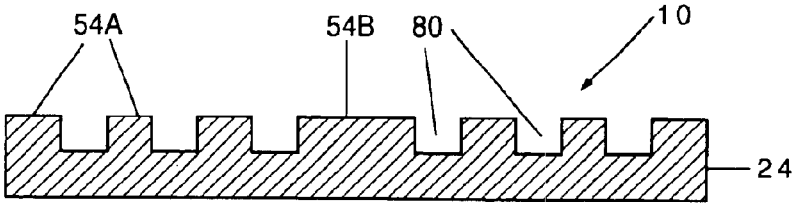
FIG. 6 is a bottom sectional view, taken along the line 6—6 of FIG. 4, more particularly illustrating the dovetail protrusions and the positioning of the perpendicular channels in the laterally outer surface of the scope mounting bar.

The dovetail guide 50 lies in a plane 51 which is perpendicular to the planes 15 and 26. The dovetail guide 50 includes an elongate rail 52 (FIG. 5) integrally mounting a dovetail shaped protrusion 54 having upper and lower edge portions 72 and 74, respectively, provided with upper and lower elongate V-shaped grooves 56 and 58, respectively. The grooves 56 and 58 are formed therein via laterally outwardly diverging surfaces 60 and 64, respectively, joined to oppositely inclined laterally outwardly converging surfaces 62 and 66, respectively. The surfaces 62 and 66 terminate in a laterally outer surface 68 lying in a plane 70 which is parallel to the planes 15 and 26. The height 76 of the protrusion 54 at the upper and lower edge portions 72 and 74, respectively, is slightly greater than the height 78 of the base portion of rail 52. A plurality of longitudinally spaced apart channels 80 are cut into the laterally outer surface 68 to provide a series of longitudinally spaced apart dovetail protrusions 54A and 54B on which the scope 12 is mounted in a manner which will be more particularly described hereinafter. The channels 80 are perpendicular to the dovetail guide 50 and the plane 51 of the dovetail guide 50.

The scope mount 10 can be manufactured from material selected from a group consisting of metal, plastic, composite plastic, glass, ceramic, wood or fiberglass. When the adjustable scope mount 10 is manufactured of aluminum, it is extremely light weight. The manufactured weight is approximately between one to two ounces, preferably, the weight is one to 1.5 ounces and most preferably the weight one to 1.25 ounces.

For mounting the scope mount 10 on the bow 14, the base plate 24 includes a plurality of vertically spaced openings, generally designated 84, therethrough individually identified from top to bottom with the reference characters 84A, 84B, 84C and 84D, respectively. A vertical plane P intersects all of the openings 84 and the midpoints M and V.

The axes of apertures 84A and 84C are spaced apart a distance D1 (FIG. 7) which is essentially equal to the distance D between the axes of the mounting ferrules 17 and 19 on the bow. The apertures 84A and 84C are used to fixably mount the scope mount 10 to the bow 14 in a first vertical position.

Figure 7:
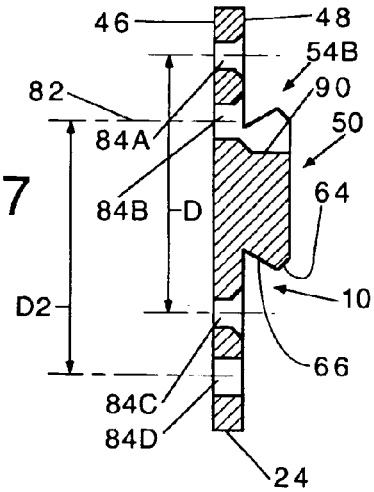
FIG. 7 is a front sectional view, taken along the section line 7—7 of FIG. 4, more particularly illustrating the adjustable mount and representing the attachment openings therethrough including the arcuate slot.

The apertures 84B and 84D mount the scope mount 10 a second vertical position and comprise a second pair of apertures which have axes that are essentially spaced apart a distance D2 which is equal to each of the distances D and D1. Upper and lower threaded pins 86 and 88 are illustrated as being received in the apertures 84B and 84D. Apertures 84A, 84B and 84C are countersunk so that a complementally formed flat head screw 86 is flush with the base surface 48. To facilitate positioning of the screw 86 in the opening 84B, a portion of the central protrusion 54B is cut away as illustrated at 901 (FIG. 7). The upper pin 86, when not tightly coupled in the bow provides a pivot which allows the scope mount 10 to swing in the direction of the arrows 91 and 92 about the axis 82 of opening 84B and screw 86.

Figure 8:
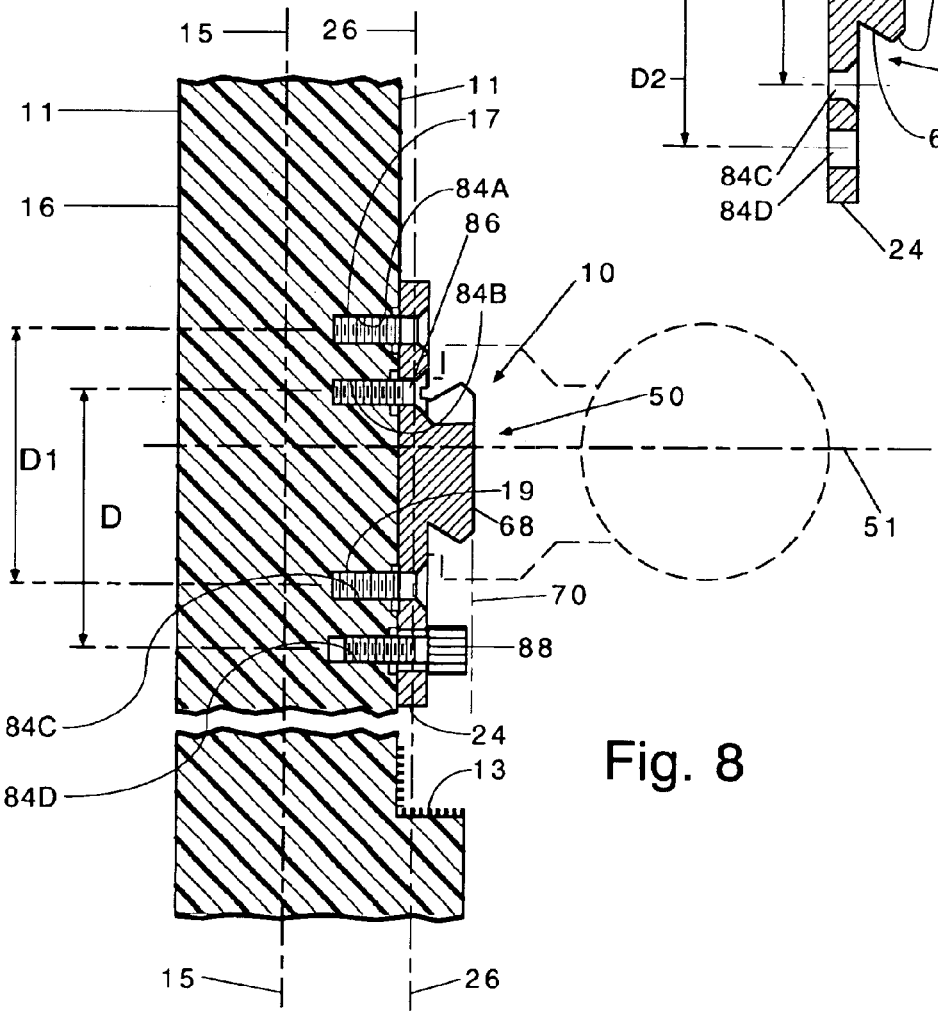
FIG. 8 is a greatly enlarged front sectional view, taken along the line 8—8 of FIG. 1, with the scope mounted thereon being illustrated in phantom lines.

A threaded pin or screw 88, received in threaded opening 19, has an enlarged head to selectively clamp the base plate 24 to the bow riser 16 in any selected one of a plurality of different horizontally and vertically adjusted positions about the axis 82. Once the scope is sighted in and properly positioned, the fasteners 86 and 88 are tightened to secure the scope mount 10 to the bow riser 16. This adjustable feature is particularly adapted for youthful hunters. More experienced hunters, who might not need this adjustability feature, can mount the scope to the bow with the pins 86 and 88 being received in the fixed openings 84A and 84C, rather than 84B and 84D is illustrated in FIG. 8. These additional apertures 84A and 84C also facilitate additional vertical adjustment of the scope mount. The plurality of openings 84 can be any selected member as long as the member of said openings does not unduly weaken the base plate 24. The openings 84 allow the archer to vertically adjust the scope mount 10 vertically along the plane P of openings 84. The lowermost opening 84D, which forms an arcuate configuration, allows the adjustable scope mount 10 to pivot about the axis 82. The limited fastening openings 84 provides a more secure system for fastening the scope mount 10 to the bow 14 which does not occur with a plurality of thumb screws or other fasteners or dials that can easily be moved out of adjustment.

The overall lateral width W of the scope mount 10 is only one-half inch and thus, presents a very low profile thereby reducing the opportunities to be inadvertently knocked out of alignment.

The scope 12 suitably comprises a RED DOT™ scope such as that sold by BSA and illustrated as Catalog No. SB-71-1194-708 at page 544 of 40$^{th}$ Anniversary Master Catalog dated Fall, 2001, Edition II sold by Cabella's Inc., Sidney, Nebr. The scope 12 includes an elongate sighting tube 92 having the usual manually adjustable site and brightness adjustment knobs 94 thereon. The sighting tube 92 is mounted to the dovetail side 50 via an upper dovetail slide 96, integral with sighting tube 92, having an elongate groove 98 therein complementally formed to the guide surfaces 60 and 62 and received in the elongate upper groove 56. A pair of longitudinally spaced apart, adjustable lower dovetail slides 99 include elongate grooves 101 clamped to the opposing surfaces 64 and. 66 of the dovetail protrusion 54.

Figure 4:
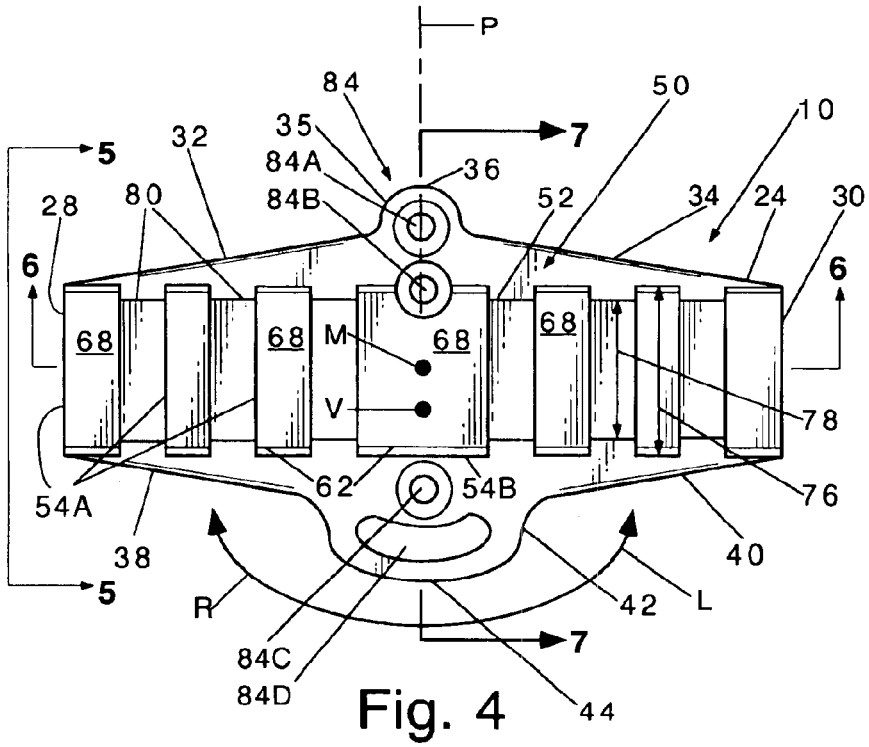
FIG. 4 is a side elevational view of the adjustable mount only.

The channels 80 project downwardly to a level below the level of the base of the elongate rail 52 as illustrated in FIG. 4. Threaded pins 97, depending from the upper dovetail slide 96 are received in apertures 103 through the lower dovetail guides 99. Knurled nuts 100 are threadedly mounted on pins 97. By turning the knurled nuts 100 onto the threaded pins 97, the adjustable dovetail slides 98 are forced upwardly into clamping engagement with the lower guide surfaces 64 and 66 and force the upper dovetail slide 96 downwardly toward the lower dovetail slides 98 into clamping engagement with the upper dovetail mount surfaces 60 and 62.

THE OPERATION

The scope mount 10 is initially adjustably mounted on the lateral side 11 of the riser 16 by a screw 86 which is received in opening 84B and partially turned into the upper threaded ferrule 17. A second screw 88 is received in the arcuate slot 84D and threaded into ferrule 19 until the screw head is initially snuggly against the laterally outer surface 48 of the plate 24 while allowing a slight swinging movement of the scope mount about the axis 82 under finger pressure exerted on the plate 24. The scope 12 is then mounted on the dovetail protrusion 54 of the dovetail guide 50 via the dovetail slides 96 and 98. The scope is longitudinally moved around the dovetail guide 50 to any selected one of a plurality of different positions and then the scope mounting pins 97 are received in selected ones of the channels 80. The adjusting nuts 94 are threaded to the pins 94 and turned to move the upper and lower dovetail slides 96 and 98, respectively, toward each other into clamping engagement with the upper and lower sides of dovetail protrusion 54.

The archer will then position an arrow on the arrow rest 13 and propel the arrow to a target. Depending on the shot accuracy, the scope mount 10 can be swung under finger pressure about the axis 82 either in a direction to the arrow R or I. The adjustment screws 94 may also be adjusted. When the archer is satisfied that the scope is accurately positioned, the archer will continue to turn the upper and lower screws 86 and 88 into the threaded ferrules 17 and 19 to insure that the adjustable mounting plate 24 is securely clamped to the compound bow riser surface 11 adjacent the arrow rest 13 in a very close fitting unobstructive manner.

The one-piece mount minimizes the possibility of the scope mount being hit, bumped or jarred in a manner which would result in misalignment of the adjustable mounting plate 24. The disposition of the scope mount 12 on the inside of the riser, where the arrow rest 13 is located, also additionally protects the scope mount 10 and scope 12 from being inadvertently struck and moved. Movement of the scope mount 10 can only be accomplished by intentional loosening of the mount nuts 100.

If a more mature hunter uses the bow, it may be desirable to again vertically and horizontally adjust the position of the scope mount on the bow. The threaded fasteners 86 and 88 are partially unthreaded from the apertures 84B and 84D, and the plate 24 is again rotated in the direction of the arrows R and L to a new position so that a propelled arrow will more accurately propel the arrow for the new archer. Also, the archer can vertically adjust the scope mount 10 by removing the screws 86 and 88 from the openings 84B and 84C and inserting same through the openings 84A and 84C and threaded into the ferrules 17 and 19. The screw 88 with the flat head illustrated in FIG. 8 could be replaced with a screw having a beveled head.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. An adjustable one-piece mount for providing adjustability for an archery scope comprising:

a unitary adjustable mounting plate having a first lateral side surface, a second lateral side surface, an upper end and a lower end;

said first lateral surface having a vertical midpoint and a horizontal midpoint, and a plurality of vertically spaced apart aligned openings located between said upper end and said lower end, the lowermost one of said openings forming an arcuate configuration; and a mounting bar horizontally integral to and projecting laterally outwardly away from said first lateral surface, said mounting bar having a third lateral surface, spaced laterally outwardly of said first lateral surface;

upper and lower opposed horizontal edges adjacent said third lateral outer surface; and a horizontal groove in each of said upper and lower edges such that said third lateral surface, said upper and lower edges and said horizontal grooves, in combination, form a dovetail protrusion, and a plurality of channels perpendicular to, and spaced along said third lateral outer surface of the mounting bar.

2. The adjustable mounting plate set forth in claim 1 wherein said plurality of vertically spaced apart openings are aligned through said vertical midpoint; and said horizontal grooves being essentially V-shaped.

3. An adjustable one-piece mount as claimed in claim 1 wherein the mount is manufactured from materials selected from a group consistent of metal, plastic, composite plastic, glass, ceramic, wood, and fiberglass.

4. The adjustable one-piece mounting plate set forth in claim 1 wherein a first pair of said openings are vertically spaced apart a predetermined distance, a second pair of said openings are vertically spaced apart said predetermined distance, the lowermost one of said first pair being disposed between said second pair of openings; said one opening, forming an arcuate configuration comprising the lowermost one of said second pair of openings.

5. An adjustable one-piece scope mount for adjustably mounting an archery scope, said scope mount comprising:

a unitary, adjustable elongate mounting plate having front and rear ends, a first lateral side surface, adapted for mounting on a bow, and a second laterally spaced apart lateral side surface, an upper terminal edge, a lower terminal edge; and a plurality of vertically spaced apart openings disposed between said upper and lower terminal edges and extending between said first and second lateral side surfaces, one of said openings forming an arcuate configuration; and an elongate dovetail sight mounting bar integral to, and projecting laterally outwardly from, said second lateral side surface;

said sight mounting bar including upper and lower edge portions, a third lateral side surface disposed between said upper and lower edge portions, spaced laterally outwardly of said second lateral side surface, an elongate groove in each of said upper and lower edge portions, and a plurality of longitudinally spaced apart, channels, perpendicular to said sight mounting bar, disposed in said third lateral side surface.

6. The mounting plate set forth in claim 5 wherein said one opening comprises the lowermost one of said aligned openings.

7. The mounting plate set forth in claim 6 wherein said elongate grooves in each of said upper and lower edge portions is V-shaped.

8. The mounting plate set forth in claim 7 wherein said V-shaped grooves are disposed laterally outwardly of said second lateral side surface.

9. The mounting plate set forth in claim 8 wherein said channels lie in a plane parallel to said predetermined plane.

10. The mounting plate set forth in claim 6 wherein said mounting plate includes a vertical mid-point between said upper and lower edges and a horizontal mid-point between said front and rear ends, said vertically spaced apart openings being aligned with said vertical mid-point and said sight mounting bar being aligned with said horizontal mid-point.

11. The adjustable mount set forth in claim 5 wherein said plate lies in a predetermined plane and said dovetailed sight mounting bar lies in a second plane perpendicular to said predetermined plane.

12. The adjustable mounting plate set forth in claim 11 wherein said longitudinally spaced apart channels lie in a third plane parallel to said predetermined plane.

13. The adjustable mount set forth in claim 5 wherein a first pair of said openings are vertically spaced apart a predetermined distance, a second pair of said openings are vertically spaced apart said predetermined distance, the lowermost one of said first pair being disposed between said second pair of openings; said one opening, forming an arcuate configuration comprising the lowermost one of said second pair of openings.

14. The adjustable mount set forth in claim 13 wherein said plate lies in a predetermined plane and said dovetail sight mounting bar lies in a second plane which is perpendicular to said base and intersects said third lateral side surface.

15. The adjustable mount set forth in claim 5 wherein said one opening and a second one of said opening are spaced apart a predetermined distance; a third one of said openings is disposed between said one opening and said second one of said openings, a fourth one of said openings is disposed above said second one of said openings, said third and fourth openings being spaced apart a distance equal to said predetermined distance between said first and second openings.

16. The adjustable mount set forth in claim 5 wherein alternate ones of said openings are spaced apart essentially the same distance.

17. An adjustable scope mount for mounting a sighting scope on an archery bow having spaced apart opposite bow ends, a riser intermediate said bow ends including front and rear spaced apart elongate edge portions spanned by laterally spaced apart elongate lateral side surfaces;

an arrow rest provided on one of said laterally spaced apart elongate surfaces;

said scope mount including:

a front to rear longitudinally extending base having front to rear longitudinally spaced apart ends, a laterally inner surface spanning said front to rear ends for abutting said one laterally spaced apart elongate surface, and a laterally outer surface disposed between said front to rear ends;

a front to rear longitudinally extending dovetail guide integral with, but projecting laterally outwardly of, said laterally outer surface for mounting the sighting scope for front to rear longitudinal movement thereon to any selected one of a plurality of longitudinally spaced apart positions; and means for swingably detachably mounting said base on said riser for swinging movement about a laterally extending axis, with said laterally inner surface of said base disposed in abutting relation with said one laterally spaced apart elongate surface.

18. The adjustable scope mount set forth in claim 17 further including a plurality of longitudinally extending, vertically spaced apart slots provided in said dovetail guide for receiving a portion of the scope.

19. The adjustable scope mount set forth in claim 18 wherein said dovetail guide includes a laterally outer dovetail guide portion including longitudinally spaced apart, longitudinally extending dovetail slots, and a plurality of longitudinally front to rear spaced apart slots through said laterally outer dovetail portion.

20. The adjustable scope mount set forth in claim 19 wherein said means for swingably detachably mounting said base includes a plurality of spaced apart apertures through said base, one of said apertures having an arcuate shape.

21. The adjustable scope mount set forth in claim 20 wherein said means for swingably detachably mounting includes a pivot extending through one of said apertures, and a guide pin received in said arcuately shaped aperture permitting arcuate swinging movement of said base about said pivot, and means receivable in at least one of said apertures for detachably locking said base to said one laterally outer surface.

22. The adjustable scope mount set forth in claim 18 wherein said base lies in a predetermined plane, said plurality of front to rear spaced apart slots are parallel to said predetermined plane.

23. The adjustable scope mount set forth in claim 22 wherein said dovetail guide lies in a plane perpendicular to said plane of said base; and said front to rear spaced apart slot lying in a third plane parallel to said predetermined plane.

24. A one-piece mounting plate for adjustably mounting a sighting scope on an upstanding archery bow having a forward mid-portion and rearwardly disposed upper and lower ends coupled to said lower mid portion and adapted to be spanned by a bow string;

said mid-portion having a pair of elongate laterally spaced apart longitudinally extending mounting surfaces;

one of said mounting surfaces including an arrow rest;

said one-piece mounting plate comprising a front to rear extending base having front and rear ends laterally spaced apart inner and outer surfaces disposed between said front and rear ends, a front to rear extending dovetail guide, integral with and projecting laterally outwardly from, said laterally outer surface of said base for mounting a sighting scope thereon for front to rear movement to any selected one of a plurality of front to rear spaced apart positions, and a plurality of laterally outwardly opening, elongate front to rear spaced apart mounting slots provided on said dovetail guide for receiving a portion of the scope.

25. The one-piece mount set forth in claim 24 wherein said base includes means for vertically and horizontally adjustably mounting said plate on the archery bow.

26. The one-piece mount set forth in claim 25 wherein said means for mounting said mounting plate on the bow comprises a plurality of spaced apart apertures extending through said base between said laterally spaced apart inner and outer surfaces for receiving a transversely extending pivot.

27. The one-piece mount set forth in claim 24 wherein said dovetail guide comprises a pair of upper and lower spaced apart guide surfaces defining front to rear extending, parallel guide rails for guiding the scope for front and rear movement thereon.

28. The mounting plate set forth in claim 24 wherein said mounting plate lies in a predetermined plane and said dovetail guide lies in a second plane perpendicular to said predetermined plane and intersects a horizontal and vertical midpoint of the plate positioned between said front and rear ends and the upper and lower terminal edges of the plate.

29. The mounting plate set forth in claim 28 wherein said front to rear spaced apart slots lie in a third plane parallel to said first plane.

30. In combination:

an elongate archery bow lying in a predetermined plane having vertically spaced apart opposite ends, a riser between and coupled to said ends including front and rear spaced apart edge portions spanned by laterally spaced apart upstanding lateral side surfaces, and an arrow-rest provided on one of said laterally spaced apart lateral side surfaces;

an adjustable one-piece scope mounting member for mounting a scope on said one lateral side surface comprising a front to rear, longitudinally extending base, lying in a second plane generally parallel to said predetermined plane, having a laterally inner surface for abutting said one lateral side, surface and a first laterally outer surface;

said first laterally outer surface including an integral laterally outwardly projecting, longitudinally extending, dovetail guide for mounting a sighting scope on said bow for front to rear sliding movement thereon to any selected one of a plurality of different, longitudinally spaced apart positions relative to said bow; and means for swingably mounted said scope mount member on said bow about an axis normal to said plane with said laterally inner surface abutting said one lateral side surface of said bow.

31. The combination set forth in claim 30 wherein said dovetail guide lies in a plane perpendicular to said second plane.

32. The combination set forth in claim 31 wherein said dovetail guide includes a second laterally outer surface spaced laterally outwardly of, and parallel to, said first laterally outer surface.

33. The combination set forth in claim 32 wherein said dovetail guide includes upper and lower spaced apart edge portions including elongate scope mounting grooves on opposite sides of said second laterally outer surface.

34. The combination set forth in claim 32 wherein said second laterally outer surface includes a plurality of vertically extending, longitudinally spaced apart scope mounting slots which lie in a third plane parallel to said second plane.

35. The combination set forth in claim 30 wherein said means for swingably mounting comprises a plurality of vertically spaced apart apertures extending through said base.

36. The combination set forth in claim 35 wherein one of said apertures is arcuate.

37. The combination set forth in claim 36, wherein said one aperture comprises the lowermost one of said apertures.

38. The combination set forth in claim 30 wherein said riser includes a pair of threaded recesses provided in said one lateral side surface and spaced apart a predetermined distance, a first pair of said openings being spaced apart said predetermined distance, the lowermost one of said pair of openings having an arcuate shape.

39. The combination set forth in claim 38 wherein at least a second pair of said openings said predetermined distance.

40. The combination set forth in claim 39 wherein the lowermost opening of said second pair of openings is disposed between said first pair of openings.

* * * * *